US006828907B1

(12) United States Patent
Galle

(10) Patent No.: US 6,828,907 B1
(45) Date of Patent: Dec. 7, 2004

(54) VEHICLE LOCATING DEVICE

(76) Inventor: John Americo Galle, 22692 Genova, Laguna Hills, CA (US) 92653

( * ) Notice: Subject to any disclaimer, the term of this patent is extended or adjusted under 35 U.S.C. 154(b) by 481 days.

(21) Appl. No.: 09/637,660

(22) Filed: Aug. 14, 2000

(51) Int. Cl.[7] ..... G08B 1/08

(52) U.S. Cl. ..... 340/539; 340/825.36; 340/825.49; 340/425.5; 342/419

(58) Field of Search ..... 340/539, 825.36, 340/825.49, 425.5; 342/357.01, 362, 367, 417, 419

(56) References Cited

U.S. PATENT DOCUMENTS 5,146,231 A * 9/1992 Ghaem ..... 342/419
5,289,163 A * 2/1994 Perez et al. ..... 340/539
5,652,569 A * 7/1997 Gerstenberger et al. .... 340/573

* cited by examiner

*Primary Examiner*—Donnie L. Crosland
(74) *Attorney, Agent, or Firm*—Goldstein Law Offices, P.C.

(57) ABSTRACT

A vehicle locating device including a transmitter securable within a vehicle. The transmitter generates a receivable signal. A receiver is provided that is in communication with the transmitter. The receiver is comprised of a housing. The housing has a top surface and a forward edge. The receiver includes an eye disposed within the forward edge of the housing. The eye detects the receivable signal of the transmitter upon being directed towards the signal. The receiver includes an illuminatable display disposed within the top surface of the housing. The illuminatable display is in communication with the eye.

1 Claim, 3 Drawing Sheets

VEHICLE LOCATING DEVICE

BACKGROUND OF THE INVENTION

The present invention relates to a vehicle locating device and more particularly pertains to allowing a vehicle owner to find the proper direction to travel in order to find their vehicle.

The use of vehicle transmitter devices is known in the prior art. More specifically, vehicle transmitter devices heretofore devised and utilized for the purpose of locating vehicles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,786,758 to Bullock discloses a vehicle locating system comprised of a transmitter and vehicle mounted receiver devices for providing a visible or audible alert. U.S. Pat. No. 5,220,319 to Kendel discloses a key holder with a remote transmitter incorporated, for locking the vehicle. U.S. Pat. No. Des. 380,895 to Tsui discloses the ornamental design for a key chain and transmitter case.

While these devices fulfill their respective, particular objective and requirements, the aforementioned patents do not describe a vehicle locating device for allowing a vehicle owner to find the proper direction to travel in order to find their vehicle.

In this respect, the vehicle locating device according to the present invention substantially departs from the conventional concepts and designs of the prior art, and in doing so provides an apparatus primarily developed for the purpose of allowing a vehicle owner to find the proper direction to travel in order to find their vehicle.

Therefore, it can be appreciated that there exists a continuing need for a new and improved vehicle locating device which can be used for allowing a vehicle owner to find the proper direction to travel in order to find their vehicle. In this regard, the present invention substantially fulfills this need.

SUMMARY OF THE INVENTION

In the view of the foregoing disadvantages inherent in the known types of vehicle transmitter devices now present in the prior art, the present invention provides an improved vehicle locating device. As such, the general purpose of the present invention, which will be described subsequently in greater detail, is to provide a new and improved vehicle locating device which has all the advantages of the prior art and none of the disadvantages.

To attain this, the present invention essentially comprises a transmitter securable within a vehicle. The transmitter generates a receivable signal. A receiver is provided that is in communication with the transmitter. The receiver is comprised of a housing. The housing has a top surface and a forward edge. The receiver includes an activation switch disposed within the top surface of the housing. The receiver includes an eye disposed within the forward edge of the housing. The eye detects the receivable signal of the transmitter upon being directed towards the signal. The receiver includes an illuminatable display disposed within the top surface of the housing. The illuminatable display is in communication with the eye. The illuminatable display includes variable signal strength lights. The receiver includes an audible signal speaker disposed within the top surface of the housing. The audible signal is in communication with the eye. A key chain ring is coupled with the forward edge of the housing of the receiver.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved vehicle locating device which has all the advantages of the prior art vehicle transmitter devices and none of the disadvantages.

It is another object of the present invention to provide a new and improved vehicle locating device which may be easily and efficiently manufactured and marketed.

It is a further object of the present invention to provide a new and improved vehicle locating device which is of durable and reliable construction.

An even further object of the present invention is to provide a new and improved vehicle locating device which is susceptible of a low cost of manufacture with regard to both materials and labor, and which accordingly is then susceptible of low prices of sale to the consuming public, thereby making such a vehicle locating device economically available to the buying public.

Even still another object of the present invention is to provide a new and improved vehicle locating device for allowing a vehicle owner to find the proper direction to travel in order to find their vehicle.

Lastly, it is an object of the present invention to provide a new and improved vehicle locating device including a transmitter securable within a vehicle. The transmitter generates a receivable signal. A receiver is provided that is in communication with the transmitter. The receiver is comprised of a housing. The housing has a top surface and a forward edge. The receiver includes an eye disposed within the forward edge of the housing. The eye detects the receivable signal of the transmitter upon being directed towards the signal. The receiver includes an illuminatable display disposed within the top surface of the housing. The illuminatable display is in communication with the eye.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
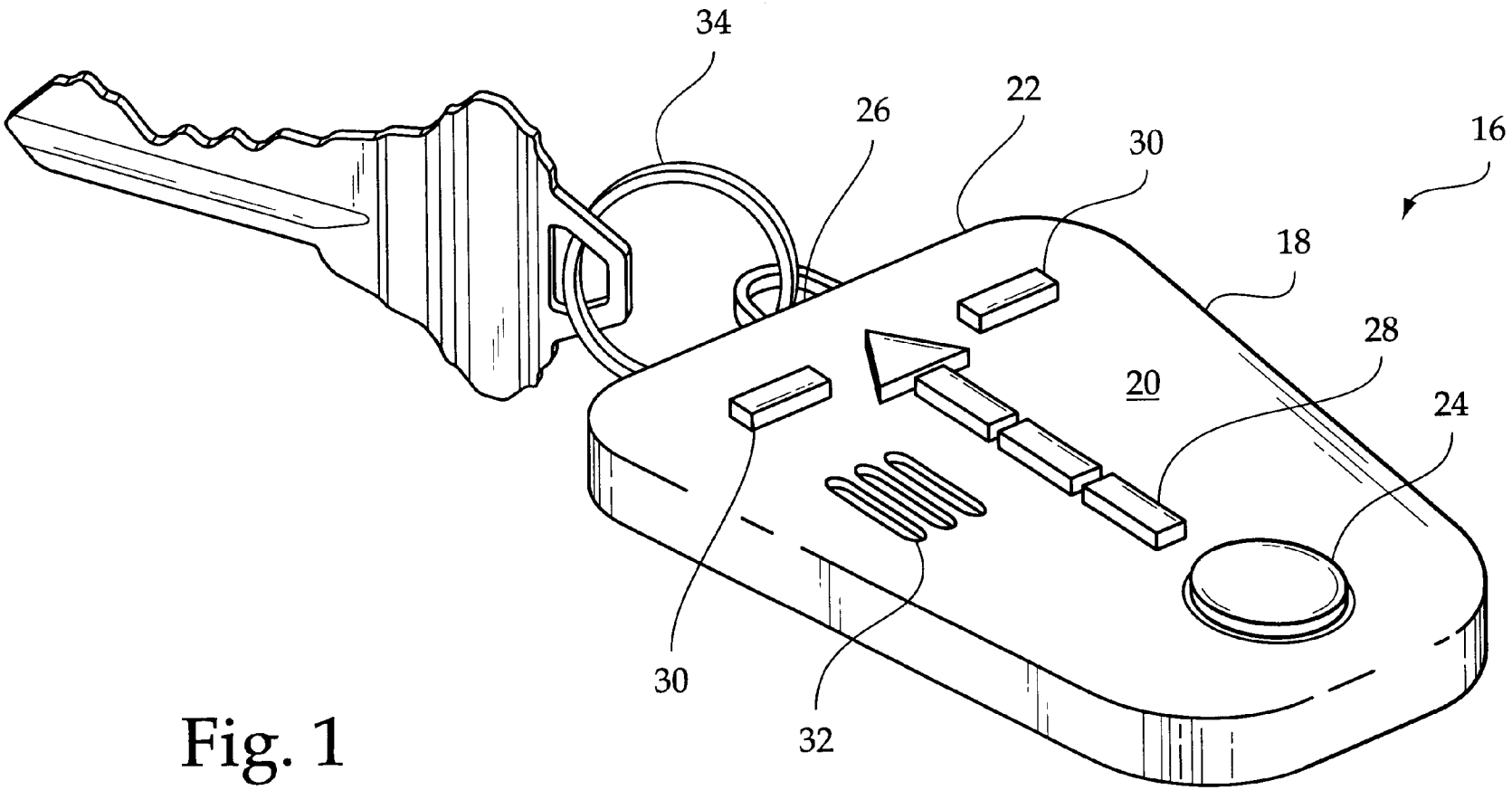
FIG. 1 is a perspective view of the preferred embodiment of the vehicle locating device constructed in accordance with the principles of the present invention.
Figure 2:
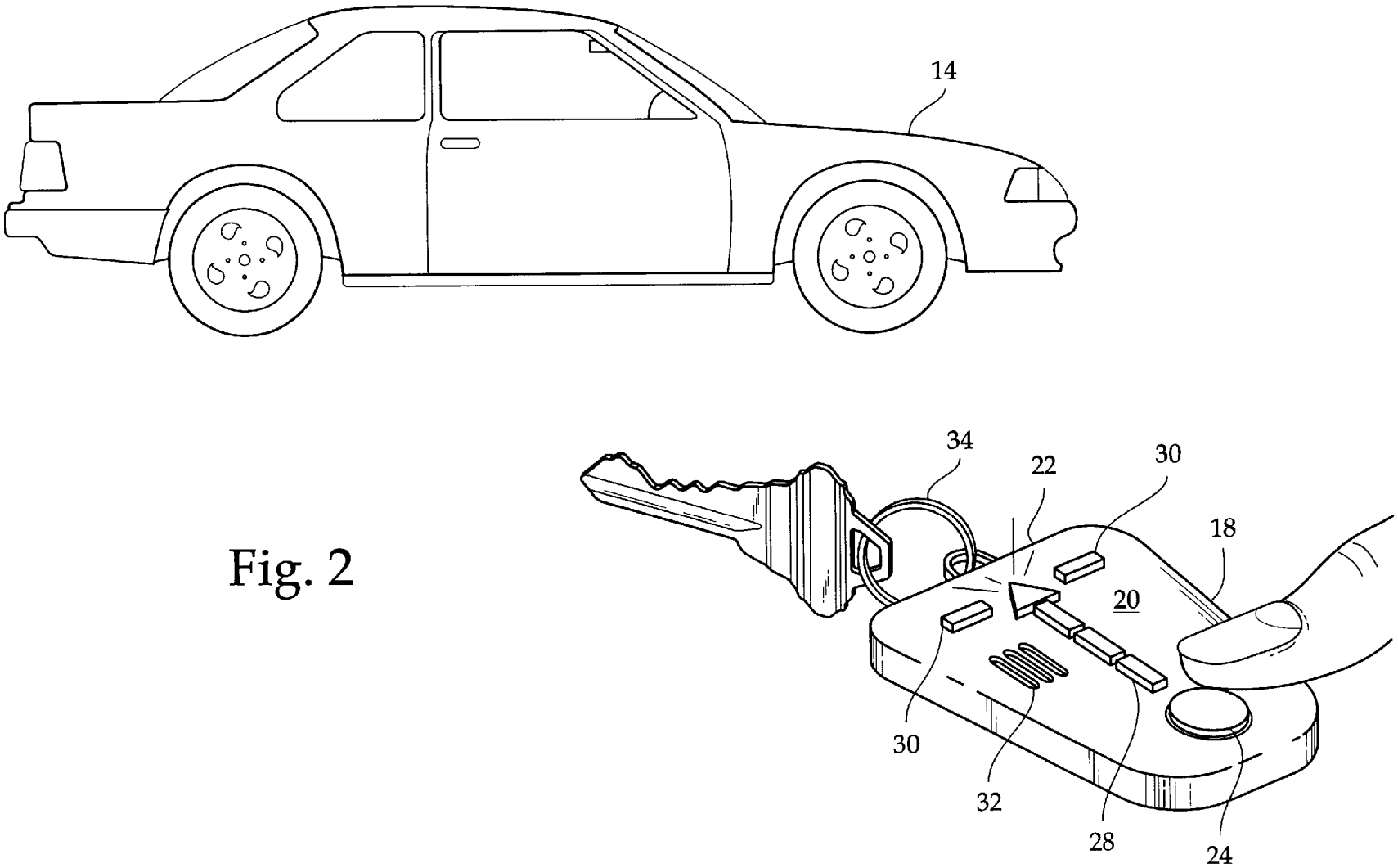
FIG. 2 is a perspective view of the present invention illustrated in use.
Figure 3:
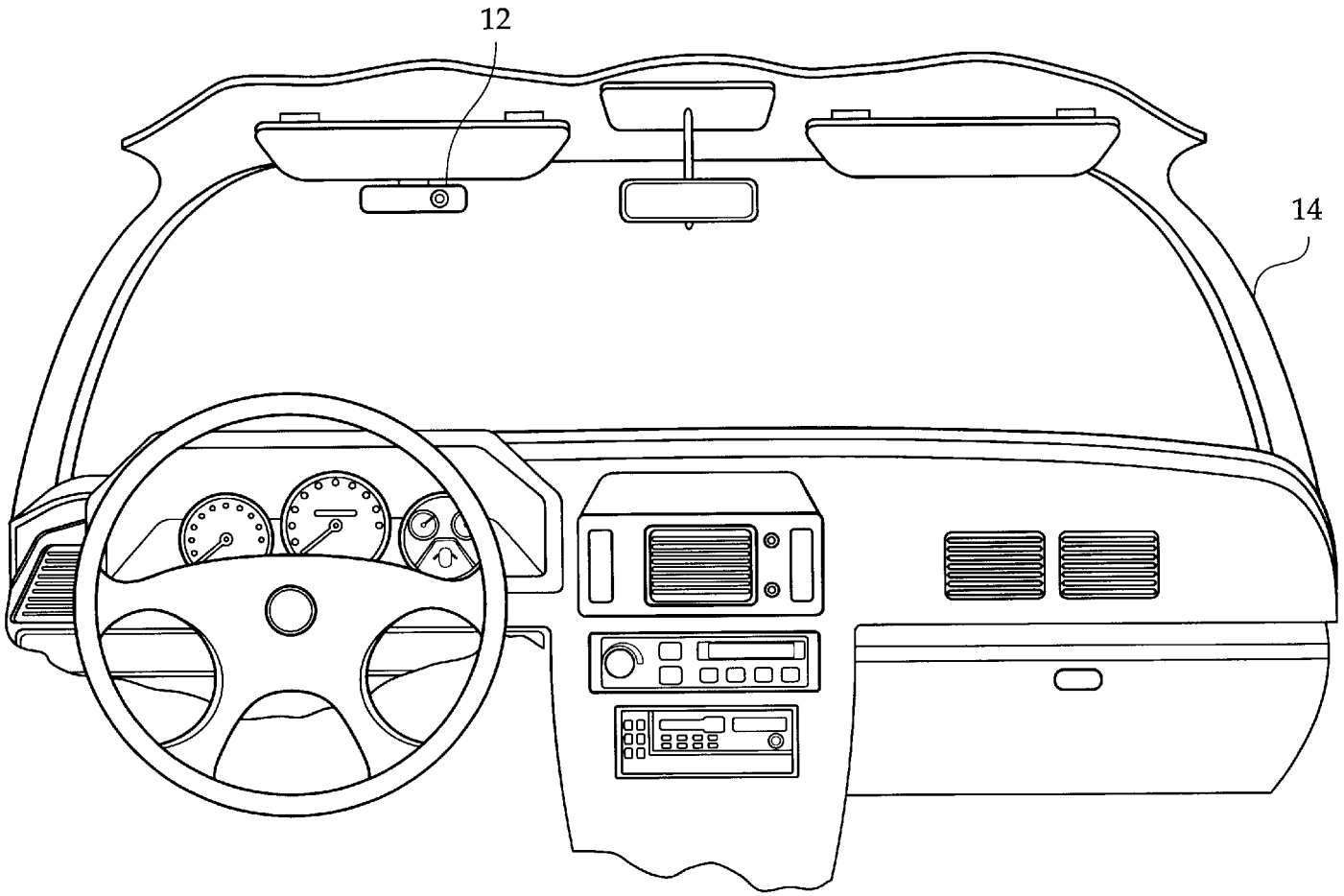
FIG. 3 is a front view of the transmitted of the present invention located within an interior of a vehicle.

With reference now to the drawings, and in particular, to FIGS. 1 through 3 thereof, the preferred embodiment of the new and improved vehicle locating device embodying the principles and concepts of the present invention and generally designated by the reference number 10 will be described.

Specifically, it will be noted in the various figures that the device relates to a vehicle locating device for allowing a vehicle owner to find the proper direction to travel in order to find their vehicle. In its broadest context, the device consists of a transmitter, a receiver, and a key chain ring. Such components are individually configured and correlated with respect to each other so as to attain the desired objective.

The transmitter 12 is securable within a vehicle 14. The transmitter 12 generates a receivable signal. Alternately, the present invention could be utilized on other items that a person would want to find, such as children and pets. For these items, securement means would need to be provided to properly secure the transmitter 12 to the child or pet. In the preferred embodiment, the transmitter 12, as illustrated in FIG. 3, is secured to the sun visor of the vehicle 14. It should be noted that the transmitter 12 would be positioned within the vehicle 14 so that the receivable signal that is generated is not obstructed in any way.

The receiver 16 is in communication with the transmitter 12. The receiver 16 is comprised of a housing 18. The housing 18 has a top surface 20 and a forward edge 22. The receiver 16 includes an activation switch 24 disposed within the top surface 20 of the housing 18. The receiver 16 includes an eye 26 disposed within the forward edge 22 of the housing 18. The eye 26 detects the receivable signal of the transmitter 12 upon being directed towards the signal. The receiver 16 includes an illuminatable display 28 disposed within the top surface 20 of the housing 18. The illuminatable display 28 is in communication with the eye 26. The illuminatable display 28 includes variable signal strength lights 30. The receiver 16 includes an audible signal speaker 32 disposed within the top surface 20 of the housing 18. The audible signal speaker 32 is in communication with the eye 26.

The key chain ring 34 is coupled with the forward edge 22 of the housing 18 of the receiver 16. The key chain ring 34 allows for the keys to the vehicle 14 to be carried with the present invention.

In use, the vehicle owner, parent, or pet owner will activate the present invention by pressing the activation switch 24 to allow the receiver 16 to search for the signal of the transmitter 12. The user simply moves the receiver 16 around to attempt to direct the eye 26 on the signal. Once the eye 26 has received the signal, the illuminatable display 28 and/or the audible signal speaker 32 will be activated. The user will then be able to walk towards their vehicle or child or pet. The variable signal strength lights 30 will light up and/or the audible signal speaker 32 will increase it's output as the user approaches their vehicle. Once the final destination ha s been reached, the user can press the activation switch 24 a second time to deactivate the present invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vehicle locating device for allowing a vehicle owner to find the proper direction to travel in order to find their vehicle comprising, in combination:

a transmitter securable within a vehicle, the transmitter generating a receivable signal;

a receiver being in communication with the transmitter, the receiver being comprised of a housing, the housing having a top surface and a forward edge, the receiver including an activation switch disposed within the top surface of the housing, the receiver including an eye disposed within the forward edge of the housing, the eye detecting the receivable signal of the transmitter upon being directed towards the signal, the receiver including an illuminatable display disposed within the top surface of the housing, the illuminatable display being in communication with the eye, the illuminatable display including variable signal strength lights, the receiver including an audible signal speaker disposed within the top surface of the housing, the audible signal being in communication with the eye; and a key chain ring coupled with the forward edge of the housing of the receiver.

* * * * *